US008366380B2

(12) United States Patent
Sakaguchi et al.

(10) Patent No.: US 8,366,380 B2
(45) Date of Patent: Feb. 5, 2013

(54) TURBO-MOLECULAR PUMP AND METHOD OF ASSEMBLING TURBO-MOLECULAR PUMP

(75) Inventors: Yoshiyuki Sakaguchi, Yachiyo (JP); Tsutomu Takaada, Yachiyo (JP)

(73) Assignee: Edwards Japan Limited (JP)

( * ) Notice: Subject to any disclaimer, the term of this patent is extended or adjusted under 35 U.S.C. 154(b) by 1444 days.

(21) Appl. No.: 11/922,655

(22) PCT Filed: Jun. 16, 2006

(86) PCT No.: PCT/JP2006/312108

§ 371 (c)(1),
(2), (4) Date: Dec. 19, 2007

(87) PCT Pub. No.: WO2006/137333

PCT Pub. Date: Dec. 28, 2006

(65) Prior Publication Data

US 2009/0116959 A1 May 7, 2009

(30) Foreign Application Priority Data

Jun. 22, 2005 (JP) ..... 2005-181389

(51) Int. Cl.
*F04D 29/32* (2006.01)

(52) U.S. Cl. ..... 415/90; 416/198 A; 416/201 R; 416/203

(58) Field of Classification Search ..... 415/190, 415/90; 416/198 R, 201 R, 198 A, 203
See application file for complete search history.

(56) References Cited

U.S. PATENT DOCUMENTS

| | | | | |
|---|---|---|---|---|
| 4,111,595 | A * | 9/1978 | Becker et al. | 415/90 |
| 6,503,050 | B2 * | 1/2003 | Reimer et al. | 415/90 |
| 2002/0076317 | A1 * | 6/2002 | Reimer et al. | 415/90 |
| 2003/0185272 | A1 * | 10/2003 | Miwata et al. | 374/120 |
| 2003/0223859 | A1 * | 12/2003 | Carboneri et al. | 415/90 |

FOREIGN PATENT DOCUMENTS

| | | |
|---|---|---|
| JP | 63034393 | 3/1988 |
| JP | 10246197 | 9/1998 |

* cited by examiner

*Primary Examiner* — Edward Look
*Assistant Examiner* — Aaron R Eastman
(74) *Attorney, Agent, or Firm* — Adams & Wilks

(57) ABSTRACT

A turbo-molecular pump has a housing with intake and exhaust ports. A rotary body is enclosed in the housing and has rotor blades of a series of stages formed so that the outside diameter of at least one stage on the exhaust port side is smaller than that on the intake port side. Stator blades are arranged between the rotor blades and spacer rings are arranged between the stator blades to hold the stator blades at predetermined intervals. The spacer rings are formed so that the smallest inside diameter of at least one stage of the spacer rings on the exhaust port side is smaller than the largest outside diameter of the rotor blades. The housing comprises a casing whose inside diameter is constant or whose inside diameter is smaller at the intake port side than at the exhaust port side.

4 Claims, 5 Drawing Sheets

(a)

(b)

(c)

TURBO-MOLECULAR PUMP AND METHOD OF ASSEMBLING TURBO-MOLECULAR PUMP

CROSS-REFERENCE TO RELATED APPLICATIONS

This application is a U.S. national stage application of International Application No. PCT/JP2006/312108, filed Jun. 16, 2006, claiming a priority date of Jun. 22, 2005, and published in a non-English language.

BACKGROUND OF THE INVENTION

1. Field of the Invention

The present invention relates to a turbo-molecular pump used, for example, for evacuation in a vacuum chamber and a method of assembling the turbo-molecular pump.

2. Description of the Related Art

Equipment using a vacuum device which accomplishes evacuation by using a vacuum pump and the interior of which is kept in vacuum includes semiconductor manufacturing equipment, liquid crystal manufacturing equipment, electron microscopes, surface analyzers, microfabrication equipment, and the like.

Also, among various types of vacuum pumps, a turbo-molecular pump is often used to realize a high-vacuum environment.

The turbo-molecular pump is configured so that a rotor rotates at a high speed in a casing having an intake port and an exhaust port. On the inner peripheral surface of the casing, stator blades are disposed in multiple stages, and on the other hand, on the rotor, rotor blades are disposed radially in multiple stages.

When the rotor rotates at a high speed, gas is sucked through the intake port and discharged through the exhaust port by the action of the rotor blades and stator blades.

The aforementioned rotor has a substantially cylindrical shape one end of which is closed, and at the end on the closed side, a rotor shaft (rotating shaft) is fixed. The rotor blades are formed in multiple stages from the intake port side toward the exhaust port side (from the upstream side toward the downstream side) so as to project radially from the outer peripheral wall surface of the rotor.

The rotor shaft of the turbo-molecular pump rotates at a high speed close to the motion velocity of gas molecule, so that a high centrifugal stress acts on the rotor blades due to this rotation. The centrifugal force acting on the rotor blades increases toward the lower stage (downstream side).

Thereupon, a technique for restraining breakage by relaxing the centrifugal stress has conventionally been proposed in the following Patent Document.

Patent Document 1: Japanese Unexamined Patent Application Publication No. 10-246197

Patent Document 1 proposes a turbo-molecular pump having a construction such that for the rotor blades provided in multiple stages, the outside diameters of the rotor blades on the exhaust port side are smaller than the outside diameters of the rotor blades on the intake port side.

By using such a construction, the centrifugal stress acting on the rotor blade and the support part thereof on the downstream side (the exhaust port side) when the rotor rotates at a high speed can be reduced, and therefore the exhaust properties of pump can be improved while restraining local stress and temperature rise.

However, the above-described turbo-molecular pump having a construction such that the outside diameters of the rotor blades on the exhaust port side are smaller than the outside diameters of the rotor blades on the intake port side as described in Patent Document 1 has a problem in that a method of assembling stator blades and spacer rings is restricted as compared with a turbo-molecular pump in which the outside diameters of rotor blades in all stages are equal.

The spacer ring is a positioning member for providing a necessary clearance between the stator blades.

For example, a case where the spacer ring is formed integrally, that is, formed into a ring shape continuous in the circumferential direction is explained.

To restrain the reduction in exhaust properties, the turbo-molecular pump has a construction such that a clearance between the inner wall of spacer ring and the outside diameter of rotor blade is decreased to prevent the backflow of gas.

Therefore, the stator blades cannot be piled up one after another from the downside (from the exhaust port side) while the spacer rings are fitted from the intake port side of rotor blade because the rotor blade on the intake port side and the spacer ring on the exhaust port side interfere with each other.

Conventionally, a method has been used in which the spacer rings are halved like the stator blades, and the stator blades are piled up one after another from the downside (from the exhaust port side) while being inserted from the radial direction.

However, for such a halved spacer ring, at the time of fabrication, that is, at the time of cutting, the cut surface may be deformed, or the external shape may be distorted.

Also, for the turbo-molecular pump using the halved spacer rings, the strength against breaking torque at the time of abnormality decreases as compared with the turbo-molecular pump using integral spacer rings that are not halved.

SUMMARY OF THE INVENTION

Accordingly, an object of the present invention is to provide a turbo-molecular pump capable of solving problems at the time when a turbo-molecular pump having a construction such that the outside diameters of rotor blades on the exhaust port side are smaller than the outside diameters of rotor blades on the intake port side and capable of improving the assembling efficiency, and a method of assembling the turbo-molecular pump.

To achieve the above object, the invention according to a first aspect provides a turbo-molecular pump including a housing having an intake port and an exhaust port; a rotating body which is enclosed in the housing and has rotor blades of a plurality of stages that are formed so that the outside diameter of at least one stage on the exhaust port side is smaller than that on the intake port side; a rotating shaft pivotally supporting the rotating body; a motor for rotating the rotating shaft; stator blades which are fixed to the housing, being arranged between the rotor blades, and each of which is divided into at least two pieces; and spacer rings each having a ring shape continuous in the circumferential direction which are arranged between the stator blades to hold the stator blades at predetermined intervals, and are formed so that the smallest inside diameter of at least one stage on the exhaust port side is smaller than the largest outside diameter of the rotor blades, characterized in that a clearance between the adjacent spacer rings which is formed in the axial direction when the spacer rings are moved to the intake port side is larger than the thickness of the stator blade.

The invention according to a second aspect, in the invention according to the first aspect, the spacer ring is formed by a ring-shaped body part having a rectangular cross section, a step part projecting from the end surface on the exhaust port side of the body part to the outer periphery, and a projecting part projecting from the step part to the exhaust port side, the projecting part of the adjacent spacer ring and the outer peripheral wall of the body part form a holding structure for holding the spacer ring by engagement, and a length obtained by adding the thickness of the stator blade to the length from the end surface on the intake port side of the body part to the end surface on the intake port side of the step part is longer than the length of the projecting part.

The invention according to a third aspect, in the invention according to the first aspect or the second aspect, an adjusting structure is provided to increase the axial displacement of the spacer ring.

The invention according to a fourth aspect, in the invention according to the third aspect, the adjusting structure is configured by a level difference which is formed on the inside and on the intake port side of the spacer ring and the inside diameter of which is larger than the outside diameter of the rotor blade.

To achieve the above object, the invention according to a fifth aspect provides a method of assembling a turbo-molecular pump having a housing having an intake port and an exhaust port; a rotating body which is enclosed in the housing and has rotor blades of a plurality of stages that are formed so that the outside diameter of at least one stage on the exhaust port side is smaller than that on the intake port side; a rotating shaft pivotally supporting the rotating body; a motor for rotating the rotating shaft; stator blades which are fixed to the housing, being arranged between the rotor blades, and each of which is divided into at least two pieces; and spacer rings each having a ring shape continuous in the circumferential direction which are arranged between the stator blades to hold the stator blades at predetermined intervals, and are formed so that the smallest inside diameter of at least one stage on the exhaust port side is smaller than the largest outside diameter of the rotor blades, characterized by including a first step of disposing only the spacer ring having an inside diameter smaller than the largest outer diameter of the rotor blades on the housing or a fixed part fixed to the housing; a second step of inserting the rotating body in the housing; a third step of moving the spacer ring disposed on the fixed part in the first step to the intake port side and thereby forming a clearance between the adjacent spacer rings; a fourth step of inserting the stator blade between the rotor blades from the outside in the radial direction through the clearance between the spacer rings formed in the third step; and a fifth step of moving the spacer ring moved in the third step to the exhaust port side and thereby fixing the stator blade inserted in the fourth step.

According to the first aspect of the invention, the clearance between the adjacent spacer rings at the time when the stator blade is assembled is formed so as to be larger than the thickness of the stator blade.

Therefore, the stator blade can be inserted through the clearance between the stacked spacer rings.

According to the second aspect of the invention, the length obtained by adding the thickness of the stator blade to the length from the end surface on the intake port side of the body part to the end surface on the intake port side of the step part is longer than the length of the projecting part. Therefore, a clearance having a proper width can be secured easily.

According to the third aspect of the invention, the adjusting structure is provided to adjust the clearance between the adjacent spacer rings at the time when the stator blade is assembled. Therefore, a necessary interval can be formed properly.

According to the fourth aspect of the invention, the adjusting structure is configured by the level difference in the interference part between the spacer ring and the rotor blade. Therefore, a clearance having a proper width can be secured easily.

According to the fifth aspect of the invention, only the spacer ring having an inside diameter smaller than the largest outside diameter of the rotor blades is disposed in advance on the fixed part. Therefore, even a turbo-molecular pump having a construction such that the outside diameters of the rotor blades on the exhaust port side are smaller than the outside diameters of the rotor blades on the intake port side can be assembled easily.

EXPLANATION OF REFERENCES

Figure 1:
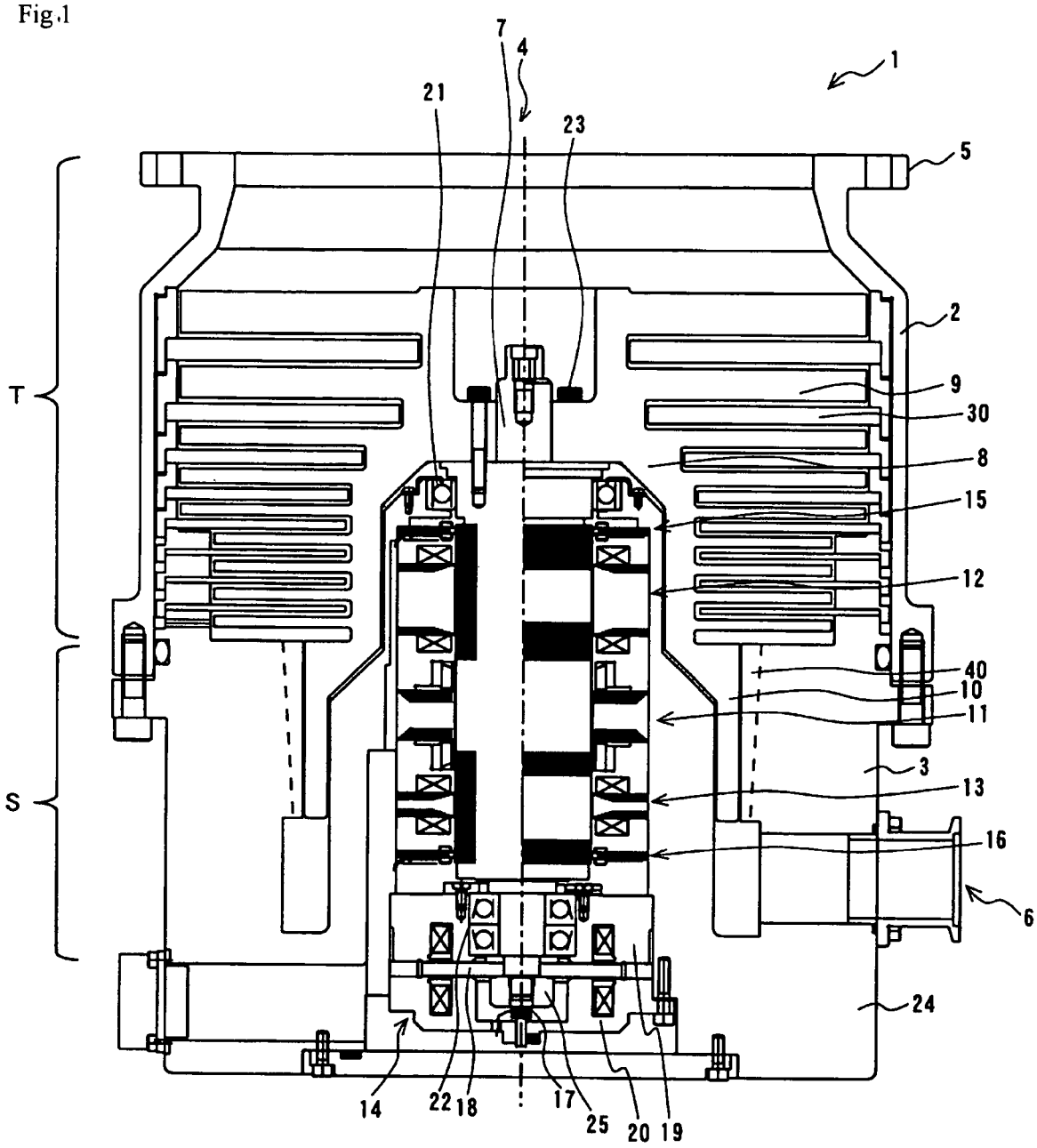
FIG. 1 is a view showing a general configuration of a turbo-molecular pump in accordance with an embodiment.

1 . . . turbo-molecular pump
2 . . . casing
3 . . . threadedly grooved spacer
4 . . . intake port
5 . . . flange part
6 . . . exhaust port
7 . . . shaft
8 . . . rotor body
9 . . . rotor blade
10 . . . cylindrical member
11 . . . motor section
12 . . . magnetic bearing section
13 . . . magnetic bearing section
14 . . . magnetic bearing section
15 . . . displacement sensor
16 . . . displacement sensor
17 . . . displacement sensor
18 . . . metal disc
19 . . . electromagnet
20 . . . electromagnet
21 . . . protective bearing
22 . . . protective bearing
23 . . . bolt
24 . . . base
25 . . . nut
30 . . . stator blade
31 . . . spacer ring
33 . . . bolt
34 . . . protruding part
35 . . . step part
40 . . . threaded groove part
311 . . . body part
312 . . . step part
313 . . . projecting part

DETAILED DESCRIPTION OF THE PREFERRED EMBODIMENTS

A preferred embodiment of the present invention will now be described in detail with reference to FIGS. 1 to 4. In this embodiment, as one example of a turbo-molecular pump, a composite turbo-molecular-pump-having a-turbo-molecular pump section T and a threadedly grooved pump section S is disclosed.

FIG. 1 is a view showing a general configuration of a turbo-molecular pump 1 in accordance with this embodiment. FIG. 1 shows a cross section in the axis line direction of the turbo-molecular pump 1. This turbo-molecular pump is disposed, for example, in semiconductor manufacturing equipment, and is used when process gas is exhausted from a vacuum chamber.

A casing 2 forming an outer shell of the turbo-molecular pump 1 has a substantially cylindrical shape, and constitutes a housing for the turbo-molecular pump 1 together with a threadedly grooved spacer 3 and a base 24 that are provided below the casing 2 (on the exhaust port 6 side). In this housing, a structure for the turbo-molecular pump 1 to perform an exhaust function, that is, a gas transfer mechanism is provided.

This gas transfer mechanism is broadly divided into two sections: a rotating section supported rotatably and a fixed section fixed to the housing.

In the end part of the casing 2, an intake port 4 for introducing gas into the turbo-molecular pump 1 is formed. Also, on the end surface on the intake port 4 side of the casing 2, a flange part 5 projecting to the outer periphery side is formed.

Also, in the end part of the threadedly grooved spacer 3, an exhaust port 6 is formed to exhaust gas from the turbo-molecular pump 1, that is, to discharge process gas etc. from the semiconductor manufacturing equipment.

The rotating section is made up of a shaft 7, which is a rotating shaft (rotary shaft), a rotor body 8 having a substantially inverse U-shaped cross section that is disposed on the shaft 7, rotor blades 9 provided on the rotor body 8, a cylindrical member 10 provided on the exhaust port 6 side (in the threadedly grooved pump section S), and the like. The rotor body 8 is fixed to the upper part of the shaft 7 by a bolt 23. Also, the cylindrical member 10 is formed on the extension of the rotor body 8, and consists of a member having a cylindrical shape that is concentric with the rotation axis line of the rotor body 8.

At the outer periphery of the rotor body 8, the rotor blades 9 are disposed. Each rotor blade 9 consists of a blade that extends radially from the shaft 7 in such a manner as to tilt through a predetermined angle from a plane perpendicular to the axis line of the shaft 7.

In a middle part in the axis line direction of the shaft 7, a motor section 11 for rotating the shaft 7 at a high speed is provided. In this embodiment, the motor section 11 is a DC brushless motor configured as described below.

The motor section 11 is provided with a permanent magnet fixed to the periphery of the shaft 7. This permanent magnet is fixed so that, for example, the N poles and the S poles are arranged every 180 degrees around the shaft 7. Also, the motor section 11 is provided with an electromagnet disposed around the permanent magnet with a predetermined clearance being provided from the shaft 7. In this embodiment, six electromagnets are arranged every 60 degrees so as to be symmetrically opposed to the axis line of the shaft 7.

The turbo-molecular pump is connected to a control unit, not shown, via a connector and a cable. By this control unit, the current of the electromagnet is changed over successively so that the rotation of the shaft 7 continues. That is to say, the control unit changes over the exciting currents of the six electromagnets, by which a rotating magnetic field is generated around the permanent magnet fixed to the shaft 7. By allowing the permanent magnet to follow this rotating magnetic field, the shaft 7 is rotated.

On the intake port 4 side and the exhaust port 6 side of the shaft 7 with respect to the motor section 11, magnetic bearing sections 12 and 13 for pivotally supporting the shaft 7 in the radial direction are provided. Also, at the lower end (exhaust port side end) of the shaft 7, a magnetic bearing section 14 for pivotally supporting the shaft 7 in the axial direction is provided.

These magnetic bearing sections 12 to 14 form what is called a five-axis control type magnetic bearing. The shaft 7 is supported in the radial direction (in the diameter direction of the shaft 7) in a noncontact manner by the magnetic bearing sections 12 and 13, and is supported in the thrust direction (in the axis direction of the shaft 7) in a noncontact manner by the magnetic bearing section 14.

Also, near the magnetic bearing sections 12 to 14, displacement sensors 15 to 17 for detecting the displacement of the shaft 7 are provided.

In the magnetic bearing section 12, four electromagnets are arranged every 90 degrees around the shaft 7 so as to be opposed to each other. The shaft 7 is formed of a material having a high magnetic permeability (iron etc.) so as to be attracted by the magnetic force of these electromagnets.

The displacement sensor 15 detects the displacement in the radial direction of the shaft 7 by performing sampling at predetermined time intervals.

When the control unit, not shown, detects the displacement in the radial direction of the shaft 7 from a predetermined position by means of the displacement signal sent from the displacement sensor 15, the control unit operates so as to return the shaft 7 to the predetermined position by regulating the magnetic force of each of the electromagnets. The regulation of magnetic force of the electromagnet is accomplished by feedback controlling the exciting current of the electromagnet.

The control unit feedback controls the magnetic bearing section 12 based on the signal of the displacement sensor 15, by which the shaft 7 is magnetically levitated in the radial direction in the magnetic bearing section 12 with a predetermined clearance being provided from the electromagnets, and is held in the air in a noncontact manner.

The configuration and operation of the magnetic bearing section 13 are the same as those of the magnetic bearing section 12. The control unit feedback controls the magnetic bearing section 13 based on the signal of the displacement sensor 16, by which the shaft 7 is magnetically levitated in the radial direction in the magnetic bearing section 13, and is held in the air in a noncontact manner.

Thus, the shaft 7 is held at a predetermined position in the radial direction by the operations of the magnetic bearing sections 12 and 13.

Also, the magnetic bearing section 14 has a disc-shaped metal disc 18 and electromagnets 19 and 20 to hold the shaft 7 in the thrust direction.

The metal disc 18 is formed of a material having a high magnetic permeability such as iron, and is fixed to the shaft 7 perpendicularly in the center thereof. The electromagnets 19 and 20 are arranged so as to hold the metal disc 18 therebetween and are opposed to each other. The electromagnet 19 attracts the metal disc 18 upward by the magnetic force, and the electromagnet 20 attracts the metal disc 18 downward.

The control unit properly regulates the magnetic forces applied to the metal disc 18 by the electromagnets 19 and 20 to magnetically levitate the shaft 7 in the thrust direction and hold the shaft 7 in the air in a noncontact manner.

Further, the displacement sensor 17 is disposed so as to be opposed to the lower end part of the shaft 7. This displacement sensor 17 detects the displacement in the thrust direction of the shaft 7 by sampling, and sends it to the control unit. The control unit detects the displacement in the thrust direction of the shaft 7 by means of the displacement detection signal received from the displacement sensor 17.

When the shaft 7 moves in either thrust direction and is displaced from a predetermined position, the control unit feedback controls the exciting currents of the electromagnets 19 and 20 so as to correct this displacement to regulate the magnetic forces, and operates so as to return the shaft 7 to the predetermined position. The control unit carries out this feedback control continuously. Thereby, the shaft 7 is magnetically levitated at the predetermined position in the thrust direction, and is held.

As explained above, the shaft 7 is held in the radial direction by the magnetic bearing sections 12 and 13, and is held in the thrust direction by the magnetic bearing section 14, so that the shaft 7 rotates around the axis line thereof.

Also, on the upper side and the lower side of the shaft 7, protective bearings 21 and 22 are arranged. Usually, the shaft 7 and the rotating section attached to the shaft 7 are pivotally supported by the magnetic bearing sections 12 and 13 in a noncontact manner during the time when they are rotated by the motor section 11. The protective bearings 21 and 22 are bearings for protecting the whole of the apparatus by pivotally supporting the rotating section in place of the magnetic bearing sections 12 and 13 in case of the occurrence of touching. Therefore, the protective bearings 21 and 22 are arranged so that the inner race is in the state of noncontact with the shaft 7.

On the inner periphery side of the housing, the fixed section is formed. This fixed section is made up of stator blades 30 provided on the intake port 4 side (in the turbo-molecular pump section T), a threadedly grooved spacer 3, and the like. In the inner wall surface of the threadedly grooved spacer 3, a threaded groove part 40 is formed.

The stator blade 30 has a blade extending from the inner peripheral surface of the housing toward the shaft so as to tilt through a predetermined angle from a plane perpendicular to the axis line of the shaft 7.

In the turbo-molecular pump section T, the stator blades 30 are formed in a plurality of stages in the axis line direction alternately with the rotor blades 9.

Figure 2:
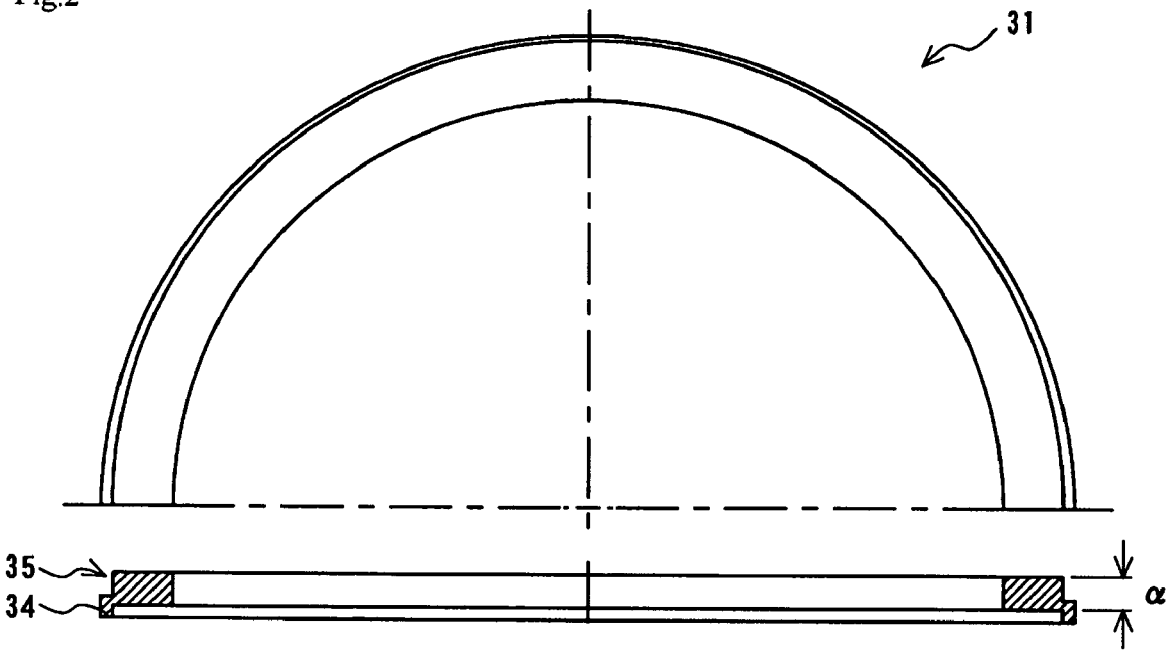
FIG. 2 is views showing one example of a configuration of a spacer ring.

The stator blades 30 in the stages are separated from each other by spacer rings 31 each having a cylindrical shape shown in FIG. 2, and are held at predetermined positions.

As shown in FIG. 2, the spacer ring 31 is a ring-shaped member having a step part, and is formed of a metal such as aluminum, iron, or stainless steel.

The interval between the adjacent stator blades 30 is set by the thickness of inner peripheral wall, that is, the length ($\alpha$) in the axial direction.

The inside diameter of the stator blade 30 in each stage is formed so as to be larger than the outside diameter of the rotor body 8 in the opposed portion so that the inner peripheral surface of the stator blade 30 does not come into contact with the outer peripheral surface of the rotor body 8.

Also, the stator blade 30 in each stage is divided into two pieces in the circumferential direction to dispose the stator blade 30 between the rotor blades 9.

The stator blade 30 is formed by cutting a semi-annular outer shape part and a blade part out of a halved thin plate formed of, for example, stainless steel or aluminum by etching or other methods and by bending the blade part through a predetermined angle by pressing.

The stator blade 30 formed in this manner is assembled by being inserted between the rotor blades 9 from the outside. The stator blade 30 is held (fixed) between the rotor blades 9 in the state in which a part thereof on the outer periphery side is held in the circumferential direction by the spacer rings 31.

The threaded groove part 40 is formed by a spiral groove formed along the surface opposed to the cylindrical member 10. The threaded groove part 40 is provided so as to face to the outer peripheral surface of the cylindrical member 10 with a predetermined clearance (gap) being provided. The direction of spiral groove formed in the threaded groove part 40 is the direction of the exhaust port 6 at the time when gas is transported in the rotation direction of the shaft 7 in the spiral groove.

Also, the depth of the spiral groove decreases toward the exhaust port 6, so that the gas transported in the spiral groove is compressed as it approaches the exhaust port 6.

Figure 3:
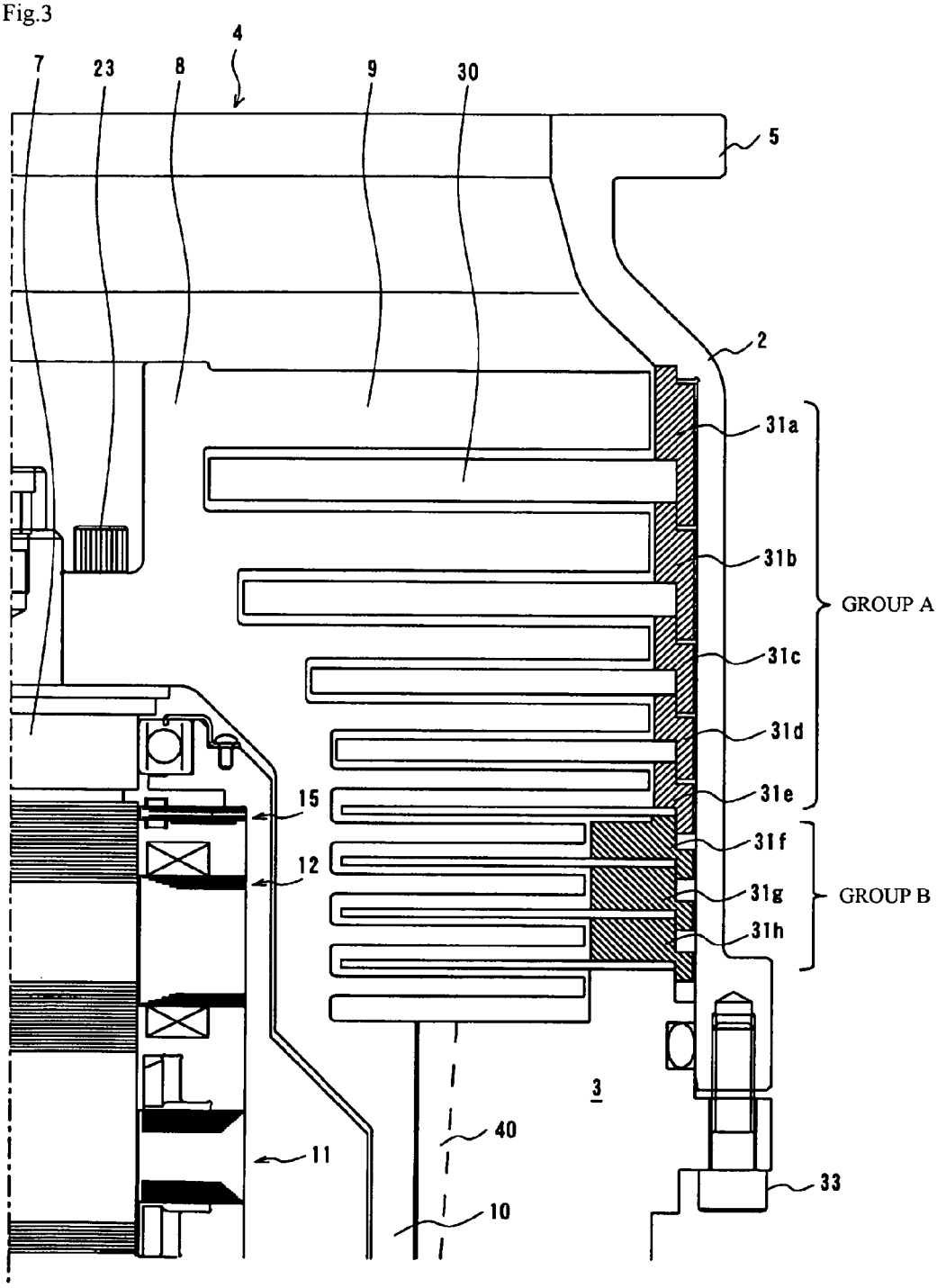
FIG. 3 is a view showing the details of peripheral portions of stator blades in a turbo-molecular pump in accordance with an embodiment.

FIG. 3 is a view showing the details of the peripheral portions of the stator blades 30 in the turbo-molecular pump 1 in accordance with this embodiment.

As shown in FIG. 3, at the outer periphery of the rotor body 8 of the turbo-molecular pump 1, the rotor blades 9 are provided in nine stages. Between the rotor blades 9 provided in nine stages, the stator blades 30 (a total of eight stages) are disposed.

Also, spacer rings 31*a* to 31*h* (eight stages) are provided to fix the stator blades 30, which are provided in eight stages, in the state in which predetermined intervals are held.

The rotor blade 9 has a different shape, for example, a different height (thickness) or a different tilt angle of blade according to the stage in which the rotor blade 9 is formed, so that the interval between the rotor blades 9 is also different according to the stage. Therefore, all of the shapes of the spacer rings 31*a* to 31*h* are not equal and different according to the shapes of the rotor blades 9 and the stator blades 30.

Each of the spacer rings 31*a* to 31*h* is provided with a protruding part 34 and a step part 35 as shown in FIG. 2. By engaging the protruding part 34 and the step part 35 of the spacer rings 31*a* to 31*h* that is adjacent to each other in the up and down direction, the spacer rings 31*a* to 31*h* are positioned and fixed.

On the surface opposed to the intake port 4 in the outer peripheral part of the threadedly grooved spacer 3, a step part having a shape corresponding to the step part 35 is formed. On the other hand, in a shoulder part (step part) near the intake port 4 in which the inside diameter of the casing 2 changes a little, a protruding part having a shape corresponding to the protruding part 34 is formed.

Also, the turbo-molecular pump 1 in accordance with this embodiment is configured so that the outside diameters of the rotor blades 9 on the exhaust port 6 side are smaller than the outside diameters of the rotor blades 9 on the intake port 4 side.

Specifically, the configuration is such that the outside diameters of the rotor blades 9 down to the fifth stage from the intake port 4 side are equal, and the outside diameters of the rotor blades 9 from the sixth stage to the ninth stage from the intake port 4 side are smaller.

The reason for this is that the centrifugal stress acting on the rotor blades 9 on the downstream side (the exhaust port 6 side) at the time when the shaft 7 rotates at a high speed is reduced.

Thus, in the turbo-molecular pump 1 in accordance with this embodiment, the outside diameter of the rotor blade 9 is also different according to the stage in which the rotor blade 9 is formed.

Also, to prevent the backflow of gas molecules at the time of turbo-molecular evacuation processing, it is necessary to decrease the clearance between the outside diameter of the rotor blade 9 and the spacer ring 31*a* to 31*h*. Therefore, the inside diameter of the spacer ring 31*a* to 31*h* opposed to the outer peripheral side surface of the rotor blade 9 differs according to the stage.

The inside diameters of the spacer rings 31*a* to 31*h* in accordance with this embodiment are formed so as to decrease stepwise from the intake port 4 side toward the exhaust port 6 side.

In this embodiment, the spacer rings 31 of eight stages each provided for every stator blade 30 are named the spacer ring 31*a*, the spacer ring 31*b*, . . . in the order from one arranged closest to the intake port 4 side, and one arranged closest to the exhaust port 6 side is named the spacer ring 31*h*.

The spacer rings 31*a* to 31*h* are provided along the inner peripheral wall of the casing 2, and the spacer ring 31*h* disposed closest to the exhaust port 6 side is disposed along the surface opposed to the intake port 4 in the outer peripheral part of the threadedly grooved spacer 3.

Also, the casing 2 has a shape such that the inside diameter in the intake port 4 side end part is decreased a little, and is configured so that in a shoulder part (step part) in which the inside diameter of the casing 2 changes a little, the spacer ring 31*a* provided closest to the intake port 4 side is fixed.

The stator blades 30 and the spacer rings 31*a* to 31*h* stacked alternately are fixed in a state of being positioned by joining the casing 2 to the threadedly grooved spacer 3 by bolts 33.

In the turbo-molecular pump 1 in accordance with this embodiment, the spacer rings 31*a* to 31*e* opposed to the rotor blades 9 down to the fifth stage from the intake port 4 side, which are formed so that the outside diameters are equal, are formed into group A, and the spacer rings 31*f* to 31*h* opposed to the rotor blades 9 from the sixth stage to the eighth stage from the intake port 4 side, which are formed so that the outside diameters are small, are formed into group B.

A method of setting a boundary when the spacer rings 31*a* to 31*h* are classified into group A and group B is explained.

As in the case of the turbo-molecular pump 1 in accordance with this embodiment, of the spacer rings 31*a* to 31*h*, the spacer rings opposed to the rotor blades 9 having the largest outside diameter on the intake port 4 side are classified into group A, and, of the spacer rings 31*a* to 31*h*, the spacer rings having an inside diameter smaller than the largest outside diameter of the rotor blade 9 is classified into group B.

That is to say, of the spacer rings 31*a* to 31*h*, the spacer rings that can be inserted from the. intake port 4 side without interference (contact) with the rotor blades 9 are classified into group A, and other spacer rings (interfering with the rotor blades 9) are classified into group B.

Next, a method of assembling the stator blades 30 and the spacer rings 31*a* to 31*h* in the turbo-molecular pump 1 in accordance with this embodiment is explained with reference to FIGS. 4(*a*) to 4(*c*).

For the turbo-molecular pump 1 in accordance with this embodiment, before the rotating section formed by the shaft 7, the rotor body 8, the rotor blades 9, and the cylindrical member 10 is attached to the base 24 being the fixed section, of the spacer rings 31*a* to 31*h*, the spacer rings having been classified into group B by the above-described method are disposed in advance on the threadedly grooved spacer 3 in a stacked state.

Figure 4:
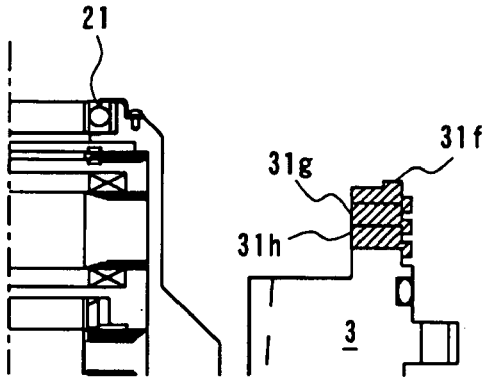
FIG. 4 is an explanatory view of a method for assembling a stator blade and a spacer ring in a turbo-molecular pump in accordance with an embodiment.
Figure 4:
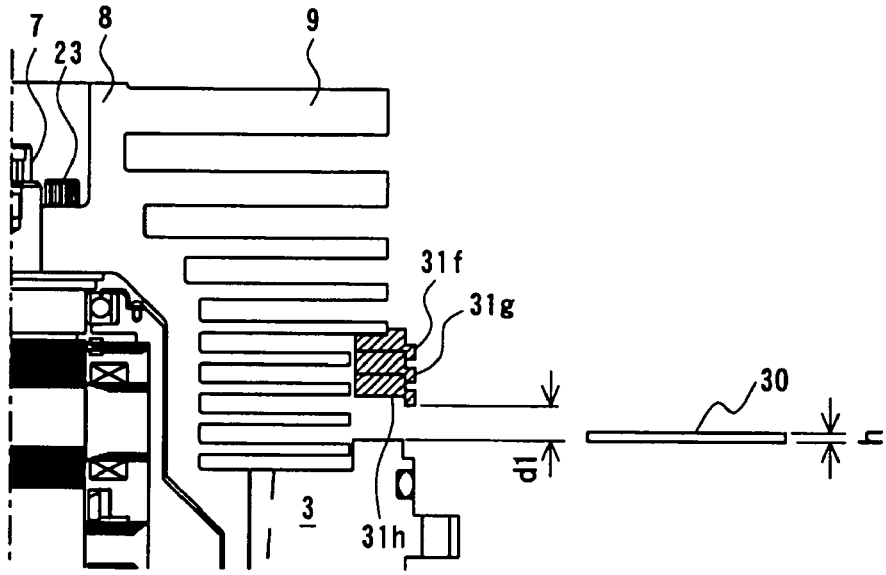
Figure 4:
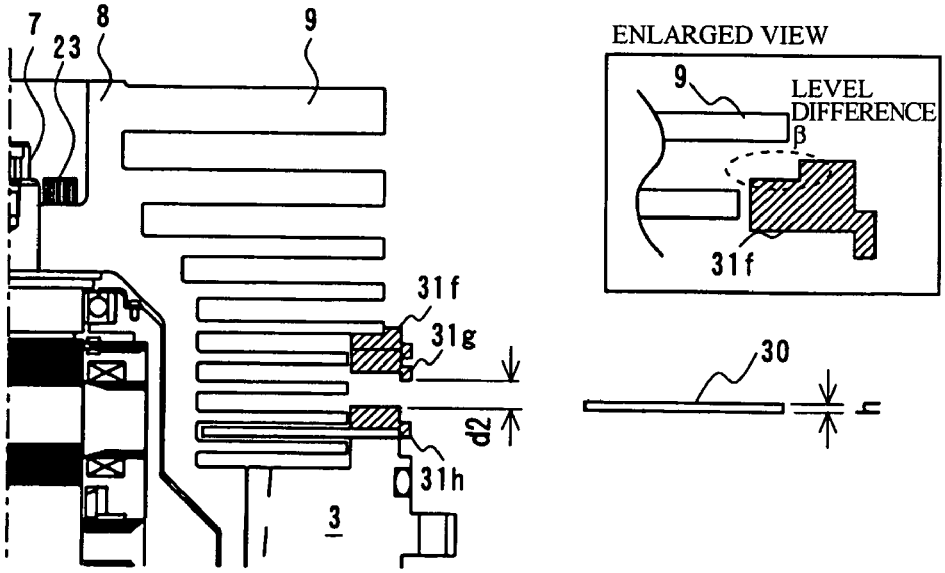

That is to say, first, as shown in FIG. 4(*a*), the spacer rings 31*f* to 31*h* of group B are set (disposed) on the threadedly grooved spacer 3 in a stacked state.

Next, the shaft 7 of the rotating section is inserted along the bearing section of the base 24 from the upside on the drawing (the intake port 4 side), and the rotating section is fixed to the base 24, which is the fixed section, by using a nut 25 (refer to FIG. 1).

Thereafter, as shown in FIG. 4(*b*), the spacer rings 31*f* to 31*h* are raised (lifted up) to provide a clearance between the spacer ring 31*h* closest to the exhaust port 6 side and the threadedly grooved spacer 3. Then, the stator blade 30 divided into two pieces in the circumferential direction, that is, having a halved shape is inserted between the rotor blades 9 from the outside in the radial direction through the clearance between the spacer ring 31*h* and the threadedly grooved spacer 3.

After the stator blade 30 has been inserted through the clearance between the spacer ring 31*h* and the threadedly grooved spacer 3, as shown in FIG. 4(*c*), the raising (lifting up) of the spacer ring 31*h* is released, that is, the spacer ring 31*h* is lowered, by which the inserted stator blade 30 is held by the threadedly grooved spacer 3 and the spacer ring 31*h*, and is fixed.

Successively, the stator blade 30 having a halved shape is inserted between the rotor blades 9 from the outside in the radial direction through a clearance between the spacer ring 31*h* and the spacer ring 31*g*, and the inserted stator blade 30 is held by the spacer ring 31*g* and the spacer ring 31*h*, and is fixed.

In the same way, the stator blade 30 is inserted between the rotor blades 9 through a clearance between the spacer ring 31*g* and the spacer ring 31*f*.

When the clearance is formed to insert the stator blade 30, it is desirable to use a special-purpose jig to raise the spacer rings 31*f* to 31*h*.

Also, in the turbo-molecular pump 1 in accordance with this embodiment, to enable the insertion of the stator blade 30, the clearance dl between the threadedly grooved spacer 3 and the spacer ring 31*h*, shown in FIG. 4(*b*), and the clearance d2 between the spacer ring 31*h* and the spacer ring 31*g*, shown in FIG. 4(*c*), are configured so as to take a value larger than the height (thickness) of the inserted stator blade 30.

Although not shown in the drawing, the clearance between the spacer ring 31*g* and the spacer ring 31*f* is also configured so as to take a value larger than the height (thickness) h of the inserted stator blade 30.

The clearance between the spacer ring 31*h* and the threadedly grooved spacer 3 and the clearance between the spacer rings 31*f* to 31*h* are movable (variable) clearances formed by raising (lifting up) the spacer rings 31*f* to 31*h*. However, the variable range of these clearances is restricted by the movable range of the spacer rings 31*f* to 31*h*.

The outside diameters of the rotor blades 9 down to the fifth stage from the intake port 4 side are formed so as to be larger than the inside diameter of the spacer ring 31*f*. Therefore, the rotor blade 9 in the fifth stage from the intake port 4 side and the spacer ring 31*f* interfere (come into contact) with each other physically, so that the movable range of the spacer ring 31*f* is restricted by this portion.

Thus, the movable range of the spacer rings 31*f* to 31*h* is restricted by a portion physically interfering (coming into contact) with the rotor blades 9, the adjacent spacer ring 31*f* to 31*h*, the inserted stator blades 30, and the like.

In the turbo-molecular pump 1 in accordance with this embodiment, considering the movable range of the spacer rings 31*f* to 31*h* restricted in this manner, the clearance through which the stator blade 30 is inserted, that is, the clearance between the spacer ring 31*h* and the threadedly grooved spacer 3 and each of the clearances between the spacers 31*f* to 31*h* is set (designed) so as to be larger than the height (thickness) h of the inserted stator blade 30.

The adjustment (regulation) of the clearance between the spacer ring 31*h* and the threadedly grooved spacer 3 and the clearances between the spacers 31*f* to 31*h* can be made by adjusting the interval at which the rotor blades 9 are formed, the height (thickness) h of the stator blade 30, the protruding part 34 on the spacer ring 31*f* to 31*h* shown in FIG. 2, the height (thickness) and shape of the spacer ring 31*f* to 31*h*, and the like.

Specifically, for example, like the spacer ring 31*f* shown in the enlarged view in FIG. 4(*c*), a level difference β is provided in the inner peripheral edge part of the upper surface (surface on the intake port 4 side) to secure (obtain) a distance necessary for preventing the interference (contact) with the rotor blade 9. This level difference β functions as an adjusting structure.

Figure 5:
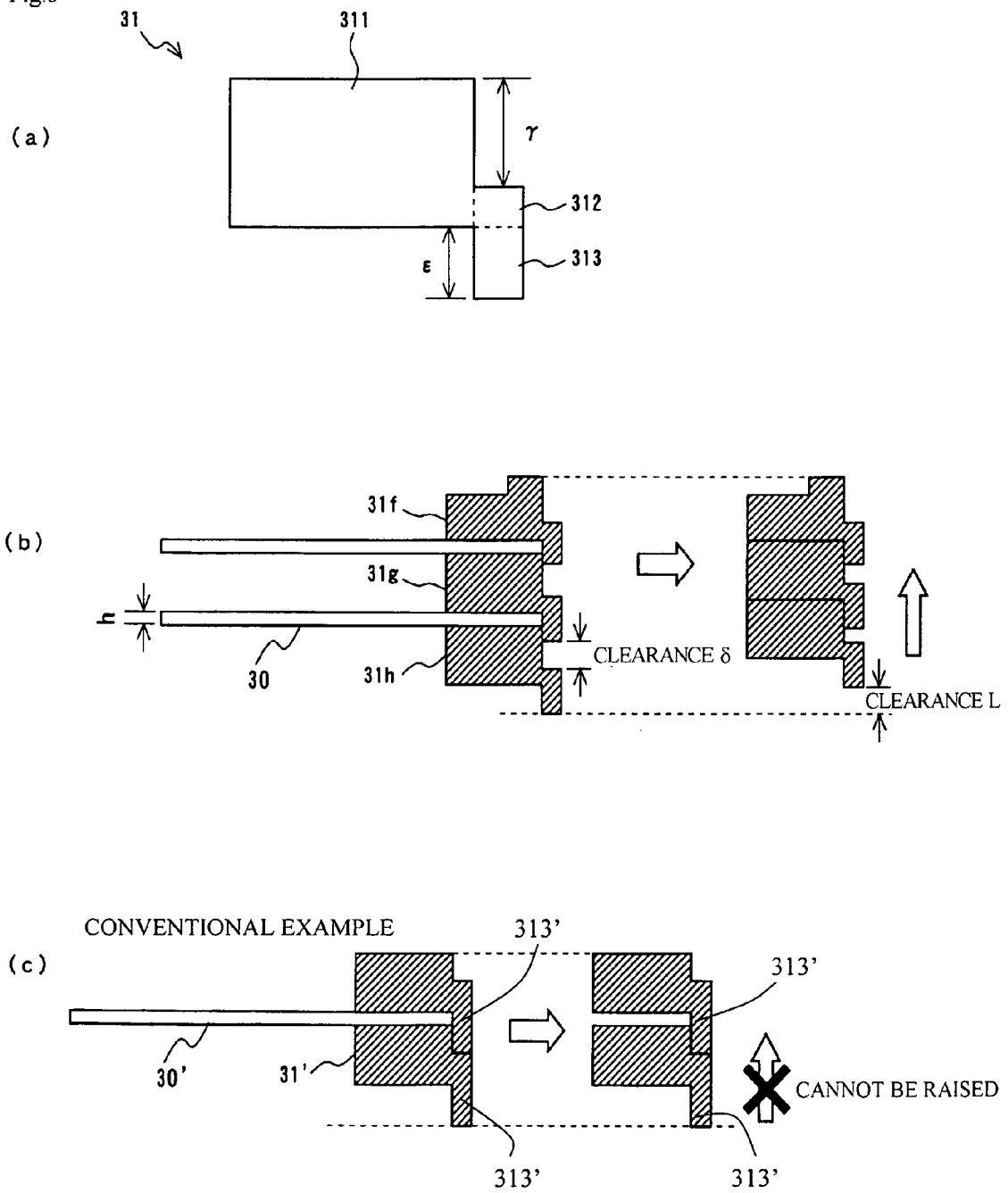
FIG. 5(*a*) is a view showing a construction of a spacer ring in accordance with an embodiment, FIG. 5(*b*) is a view showing an assembling construction of the spacer ring in accordance with an embodiment, and FIG. 5(*c*) is a view showing an assembling construction of a conventional spacer ring.

Also, as shown in FIG. 5(*a*), the spacer ring 31 in the turbo-molecular pump 1 in accordance with this embodiment is formed by a ring-shaped body part 311 having a rectangular cross section, a step part 312 projecting from the end surface on the exhaust port 6 side of the body part 311 to the outer periphery, and a projecting part 313 projecting from the step part 312 to the exhaust port 6 side.

The projecting part 313 of the adjacent spacer ring 31 and the outer peripheral wall of the body part 311 form a holding structure for holding the spacer ring 31 by engagement.

Further, the configuration is made such that the length obtained by adding the thickness (h) of the stator blade 30 to the length (γ) from the end surface on the intake port 4 side of the body part 311 to the end surface on the intake port 4 side of the step part 312 is longer than the length (ε) of the projecting part 313.

By configuring the holding structure for the spacer ring 31 in this manner, a clearance δ is formed between the projecting parts 313 of the adjacent spacer rings 31 as shown in FIG. 5(*b*) when the stator blade 30 is inserted.

In the state in which the stator blade 30 is not inserted, as shown in FIG. 5(*b*), a clearance L for inserting the stator blades 30 can be formed properly.

In the holding structure for a spacer ring 31' of the conventional example, as shown in FIG. 5(*c*), no clearance is formed between projecting parts 313' of the adjacent spacer rings 31' when the stator blade 30' is inserted, so that the spacer ring 31' cannot be raised to form a clearance for inserting a stator blade 30'.

After the stator blades 30 have been inserted through the clearance between the spacer ring 31*h* and the threadedly grooved spacer 3 and the clearances between the spacer rings 31*f* to 31*h* , the stator blade 30 is inserted between the rotor blades 9 on the upper surface (the intake port 4 side surface) of the spacer ring 31*f* from the outside in the radial direction. Then, the spacer ring 31*e* is fitted from the intake port 4 side to fix the stator blade 30.

That is to say, after the stator blades 30 have been disposed between the spacer rings 31*f* to 31*h* of group B, the stator blade 30 is further inserted from the outside in the radial direction, and the spacer rings 31*a* to 31*e* of group A are piled up one after another from the exhaust port 6 side while being fitted along the outside diameters of the rotor blades 9 from the intake port 4 side.

A method of piling up (fitting) the spacer rings 31*a* to 31*e* of group A is the same as the conventional method.

After all of the stator blades 30 and the spacer rings 31*a* to 31*h* have been assembled, the casing 2 is installed so as to cover the spacer rings 31*a* to 31*h*, and the casing 2 is fixed to the threadedly grooved spacer 3. The casing 2 is fixed by using fastening members such as the bolts 33, for example, as shown in FIG. 3.

By fixing the casing 2 to the threadedly grooved spacer 3, the spacer rings 31*a* to 31*h* are fixed, and the stator blades 30 are fixedly disposed at proper positions between the rotor blades 9.

As described above, in this embodiment, of the spacer rings 31*a* to 31*h*, the spacer rings that cannot be fitted from the intake port 4 side because of the interference (contact) with the rotor blade 9 are disposed on the threadedly grooved spacer 3 in a stacked state before the rotating section (rotating body/rotary body) is fixedly disposed on the fixed section (the base 24).

Specifically, the spacer rings 31*f* to 31*h* that cannot be fitted from the intake port 4 side because of the interference (contact) with the rotor blade 9 are disposed in advance on the threadedly grooved spacer 3, that is, on fixed member (fixed side) on which the spacer ring 31*h* is disposed.

The turbo-molecular pump 1 in accordance with this embodiment has a construction such that the turbo-molecular pump 1 is not assembled so that the spacer rings 31*f* to 31*h* are fitted on the rotor blades 9 and are stacked, but assembled so that the rotor blades 9 (the rotor body 8) are fitted in the stacked spacer rings 31*f* to 31*h*.

Since the turbo-molecular pump 1 in accordance with this embodiment has such a construction, the turbo-molecular pump 1 has a construction such that the outside diameters of the rotor blades 9 on the exhaust port 6 side are smaller than the outside diameters of the rotor blades 9 on the intake port 4 side. However, the spacer rings 31*a* to 31*h* that do not have a halved shape (that is, are integral) can be assembled easily.

According to this embodiment, even in the turbo-molecular pump 1 having the construction such that the outside diameters of the rotor blades 9 on the exhaust port 6 side are smaller than the outside diameters of the rotor blades 9 on the intake port 4 side, the stator blades 30 can be assembled (piled up) without the use of spacer rings that are divided into two pieces in the circumferential direction.

That is to say, even in the turbo-molecular pump 1 having the construction such that the outside diameters of the rotor blades 9 on the exhaust port 6 side are smaller than the outside diameters of the rotor blades 9 on the intake port 4 side, the assembling work can be performed one after another from the downside as in the conventional example, so that the assembling ability at the manufacturing time is not decreased.

Also, by using the integral spacer rings 31*a* to 31*h* continuous in the circumferential direction, the strength can be improved as compared with the turbo-molecular pump using halved spacer rings. In particular, the strength against breaking torque at the time of abnormality can be improved.

Further, the integral spacer rings 31*a* to 31*h* continuous in the circumferential direction have no possibility of the occurrence of troubles during processing (cutting) such as the deformation of cut surface, the distortion of external shape, and the shift of joint part (mating part), which may occur in the case of the halved spacer ring.

According to this embodiment, since the construction such that the outside diameters of the rotor blades 9 on the exhaust port 6 side are smaller than the outside diameters of the rotor blades 9 on the intake port 4 side is adopted, the centrifugal stress acting on the rotor blade 9 on the downstream side (the exhaust port 6 side) when the shaft 7 rotates at a high speed can be reduced, so that the durability of the turbo-molecular pump 1 can be improved.

What is claimed is:

1. A turbo-molecular pump comprising:

a housing having an intake port and an exhaust port;

a rotary body which is enclosed in the housing and has rotor blades of a plurality of stages that are formed so that the outside diameter of at least one stage on the exhaust port side is smaller than that on the intake port side;

a rotary shaft pivotally supporting the rotary body;

a motor for rotating the rotary shaft;

stator blades which are fixed to the housing, being arranged between the rotor blades, and each of which is divided into at least two pieces; and spacer rings each having a ring shape continuous in the circumferential direction which are arranged between the stator blades to hold the stator blades at predetermined intervals, and are formed so that the smallest inside diameter of at least one stage of the spacer rings on the exhaust port side is smaller than the largest outside diameter of the rotor blades;

wherein the housing comprises a casing whose inside diameter is constant or whose inside diameter is smaller at the intake port side than at the exhaust port side; and wherein a clearance between the adjacent spacer rings which is formed in an axial direction when the spacer rings are moved to the intake port side is larger than a thickness of the stator blade.

2. A turbo-molecular pump according to claim 1; wherein:

the spacer ring is formed by a ring-shaped body part having a rectangular cross section, a step part projecting from the end surface on the exhaust port side of the body part to the outer periphery, and a projecting part projecting from the step part to the exhaust port side;

the projecting part of the adjacent spacer ring and the outer peripheral wall of the body part form a holding structure for holding the spacer ring by engagement; and a length obtained by adding the thickness of the stator blade to the length from the end surface on the intake port side of the body part to the end surface on the intake port side of the step part is longer than the length of the projecting part of.

3. A method of assembling a turbo-molecular pump having:

a housing having an intake port and an exhaust port;

a rotary body which is enclosed in the housing and has rotor blades of a plurality of stages that are formed so that the outside diameter of at least one stage on the exhaust port side is smaller than that on the intake port side;

a rotary shaft pivotally supporting the rotary body;

a motor for rotating the rotary shaft;

stator blades which are fixed to the housing, being arranged between the rotor blades, and each of which is divided into at least two pieces; and spacer rings each having a ring shape continuous in the circumferential direction which are arranged between the stator blades to hold the stator blades at predetermined intervals, and are formed so that the smallest inside diameter of at least one stage of the spacer rings on the exhaust port side is smaller than the largest outside diameter of the rotor blades, the method comprising:

a first step of disposing only the spacer ring having an inside diameter smaller than the largest outer diameter of the rotor blades on the housing or a fixed part fixed to the housing;

a second step of inserting the rotating body in the housing;

a third step of moving the spacer ring disposed on the fixed part in the first step to the intake port side and thereby forming a clearance between the adjacent spacer rings;

a fourth step of inserting the stator blade between the rotor blades from the outside in the radial direction through the clearance between the spacer rings formed in the third step; and a fifth step of moving the spacer ring moved in the third step to the exhaust port side and thereby fixing the stator blade inserted in the fourth step.

4. A turbo-molecular pump comprising:

a housing having an intake port and an exhaust port;

a rotary body which is enclosed in the housing and has rotor blades of a plurality of stages that are formed so that the outside diameter of at least one stage on the exhaust port side is smaller than that on the intake port side;

a rotary shaft fixed to the rotary body;

a motor for rotating the rotary shaft;

stator blades which are fixed to the housing, being arranged between the rotor blades, and each of which is divided into at least two pieces blades; and spacer rings each having a ring shape continuous in the circumferential direction which are arranged between the stator blades to hold the stator blades at predetermined intervals, and are formed so that the smallest inside diameter of at least one stage of the spacer rings on the exhaust port side is smaller than the largest outside diameter of the rotor blades;

wherein the housing comprises a casing whose inside diameter is constant or whose inside diameter is smaller at the intake port side than at the exhaust port side; and wherein a clearance between the adjacent spacer rings which is formed in an axial direction when the spacer rings are moved to the intake port side is larger than a thickness of the stator blade.

* * * * *